US005103136A

United States Patent [19]

Suzuki et al.

[11] Patent Number: 5,103,136

[45] Date of Patent: Apr. 7, 1992

[54] IGNITER PLUG

[75] Inventors: Takahiro Suzuki; Yuuki Izuoka, both of Nagoya, Japan

[73] Assignee: NGK Spark Plug Co., Ltd., Nagoya, Japan

[21] Appl. No.: 700,531

[22] Filed: May 14, 1991

[51] Int. Cl.[5] ..... H01J 7/32; H01J 13/20

[52] U.S. Cl. ..... 315/59; 313/131 A; 313/131 R; 313/141; 313/144

[58] Field of Search ..... 315/56, 58, 59; 313/131 A, 131 X, 141, 144

[56] References Cited

U.S. PATENT DOCUMENTS

| | | | |
|---|---|---|---|
| 4,419,601 | 12/1983 | Hamai et al. | 313/131 A |
| 4,795,937 | 1/1989 | Wagner et al. | 313/141 X |
| 4,814,664 | 3/1989 | Rothenbuhler | 313/131 R |
| 4,873,466 | 10/1989 | Matsumura et al. | 313/131 R |
| 4,951,173 | 8/1990 | Suzuki et al. | 313/131 A X |
| 4,963,784 | 10/1990 | Niessner | 313/131 R |
| 4,973,877 | 11/1990 | Suzuki et al. | 313/131 A |

*Primary Examiner*—Eugene R. LaRoche

*Assistant Examiner*—Son Dinh

*Attorney, Agent, or Firm*—Cooper & Dunham

[57] ABSTRACT

An igniter plug has a metallic shell, a front end of which has a tubular ground electrode. A hollow semiconductor tip is in the form of inversed frusto-cone shape, and placed within the tubular ground electrode. A tubular insulator is placed within the metallic shell to be in alignment with the semiconductor tip. A center electrode is placed within the insulator, a front end of the center electrode passing through the semiconductor tip to provide an annular discharge gap between the front end of the center electrode and that of the ground electrode. A low resistor layer provided on a front end surface of the semiconductor tip. An electrical resistance of the layer is determined to be smaller than that of the semiconductor tip, while a thickness of the layer is such that the layer precedes the semiconductor tip in forming a discharge path between the front end of the center electrode and that of the ground electrode only during a predetermined period after the igniter plug is initially operated.

8 Claims, 3 Drawing Sheets

IGNITER PLUG

BACKGROUND OF THE INVENTION

1. Field of the Invention

This invention relates to an igniter plug for use in gas turbine engine, diesel engine and various kinds of burners, and particularly concerns to an igniter plug which is improved to substantially insure stable sparks at a certain voltage from the very beginning when the igniter plug is initially operated.

2. Description of Prior Art

In an igniter plug, a semiconductor tip is provide between a front end of a ground electrode and that of a center electrode to form a creeping discharge gap therebetween. With the elapse of initially operating time period (approx. 2500 hours), a quantity of discharge energy thus far released causes to locally transform the semiconductor tip into a low resistor which allows to establish sparks at as relatively low voltage as 1800 V.

Before the passage of the initially operating time period, the semiconductor tip, however, causes to vary a magnitude of voltage necessary to discharge between the ground electrode and the center electrode, thus renders incapable of insuring stable sparks therebetween.

Therefore, it is an object of the invention to eliminate the above drawbacks, and providing a discharge structure which is substantially capable of insuring stable sparks at a certain low voltage from the very beginning when the igniter plug is initially operated.

SUMMARY OF THE INVENTION

According to the present invention, there is provided an igniter plug comprising; a cylindrical metallic shell, a front end of which has a tubular ground electrode; a hollow semiconductor tip which is in the form of inversed frusto-cone shape, and concentrically placed within the tubular ground electrode; a tubular insulator placed within the metallic shell to be in alignment with the semiconductor tip; a center electrode concentrically placed within the insulator, a front end of the center electrode passing through the semiconductor tip to extend beyond a front end of the semiconductor tip so as to provide an annular discharge gap between the front end of the center electrode and that of the ground electrode; and a low resistor layer provided on a front end surface of the semiconductor tip, an electrical resistance of the layer being determined to be smaller than that of the semiconductor tip, while a thickness of the layer being such that the layer precedes the semiconductor tip in forming a discharge path between the front end of the center electrode and that of the ground electrode only during a predetermined time period after the igniter plug is initially operated.

The structure is such that the low resistor layer works as a discharge path between the center electrode and the ground electrode until the discharge energy transforms the semiconductor into a low resistor.

This makes it possible to substantially insure stable sparks at a certain low voltage from the very beginning when the igniter plug is initially operated.

Various other objects and advantages to be obtained by the present invention will be appeared in the following description and in the accompanying drawings.

DETAILED DESCRIPTION OF PREFERRED EMBODIMENT

Figure 1:
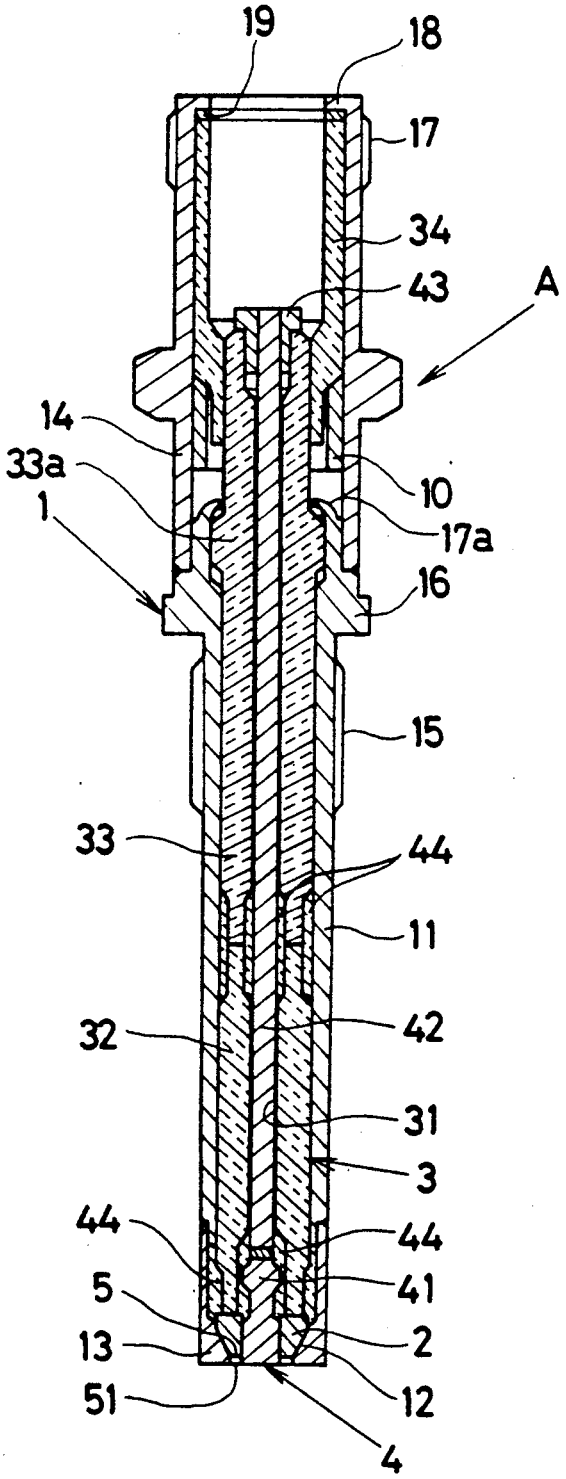
FIG. 1 is a longitudinal cross sectional view of an igniter plug according to an embodiment of the invention.

Referring to FIG. 1, there is shown an igniter plug (A) which has a cylindrical metallic shell 1, and a hollow semiconductor tip 2. The semiconductor tip 2 is in the form of inversed frusto-cone shape, an inner hollow space serves as an axial hole 20, and concentrically placed within a tubular ground electrode 13 as described in detail hereinafter. Within the metallic shell 1, is a tubular insulator 3 placed, an inner space of which serves as an axial bore 31 into which a center electrode 4 is inserted. The metallic shell 1 has a main body 11, an outer surface of which has a male thread 15, a flange mount 16 and a caulking edge 17*a* each arranged in a vertical relationship. To a front end of the main body 11, is the tubular ground electrode 13 rigidly connected which is made of tungsten-based alloy. With an inner wall of the ground electrode 13, is a tapered surface 12 provided, on which the semiconductor tip 2 is concentrically seated snug through its outer surface 22. To a rear end of the main body 11, is a connector tube 14 rigidly connected at the flange mount 16 by means of welding. An outer surface of the connector tube 14 has a male thread 17 while a rear end of the connector tube 14 has an annular stopper 18.

The semiconductor tip 2 is a sintered body made of silicon carbide (SiC) and alumina ($Al_2O_3$) as a main components.

Figure 2A:
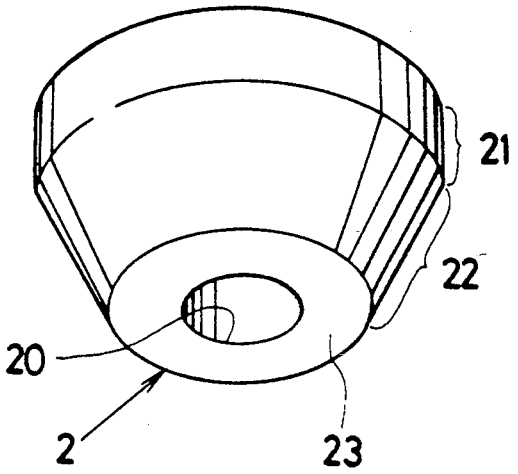
FIG. 2*a* is an enlarged perspective view of a semiconductor tip before a low resistor layer is provided.
Figure 2B:
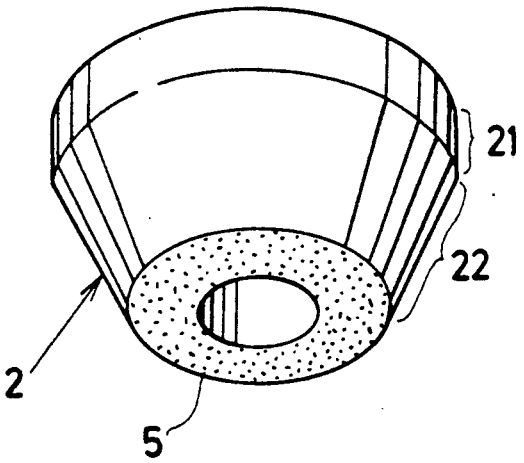
FIG. 2*b* is an enlarged perspective view of a semiconductor tip after a low resistor layer is provided.

As shown in FIG. 2*a*, the semiconductor tip 2 has a bevelled portion 21 at its upper edge which is continuouly extended from the outer surface 22, and located to be in alignment with the insulator 3. On a front end surface 23 of the tip 2, is a low resistor layer 5 put together by means of baking as depicted by pear-skin mark in FIG. 2*b*. The low resistor layer 5 is made of antimony trioxide ($Sb_2O_3$) with addition of oxidized tin (SnO) prepared as described in detail hereinafter. A thickness of the layer 5 is determined to be within the range from 5 μm to 200 μm so that the layer 5 precedes the semiconductor tip 2 in forming a discharge path between a front end of the center electrode 4 and that of the ground electrode 13 only during a predetermined time period (equivalent to 1000~5000 times of sparks) after the igniter plug (A) is initially operated.

On the other hand, an electrical resistance of the layer 5 is determined to be less than 0.5MΩ exclusive since an electrical resistance of the tip 2 is usually 0.5MΩ~100MΩ at the time when the igniter plug (A) is initially operated.

The insulator 3 consists of a front piece 32, a rear piece 33 and a rear end piece 34 which are linearly connected to be in alignment with each other. A front end of the piece 32 is thickness-reduced, and butts on a rear end of the semiconductor tip 2. With an assist of a retainer ring 10, the rear end piece 34 is telescoped at its front end into a rear portion of the rear piece 33, and bringing a rear end of the piece 34 into engagement with the stopper 18 by way of a washer 19.

Meanwhile, the rear piece 33 of the insulator 3 has an outer step 33*a* with which the caulking edge 17*a* tightly engages to rigidly locate the insulator 3 in place.

The center electrode 4 consists of a middle axis 42 made of nickel-based alloy, and a tip 41 made of tungsten-based alloy. The middle axis 42 placed within the axial bore 31 is brazed at its rear end to a terminal 43 which is inserted into a rear end of the rear piece 33. To a front end of the middle axis 42, is the tip 41 connected, a front end of which passes through the axial hole 20 of the tip 2, and slightly extends beyond the front end surface 23 to form a creeping discharge gap 51 between the front end of the tip 41 and that of the ground electrode 13. A glass sealant 44 is provided to fill respective space appeared among the ground electrode 13, the front end of the rear piece 32 and the tip 41.

The low resistor layer 5 is prepared as follows:

(1) 90 wt %~97 wt % oxidized is mixed with 3 wt %~10 wt % antimony trioxide with addition of 50 wt % water of the total weight. With addition of broken stones, the mixture, thus prepared, is churned in a polyethylene pot (not shown) for 5~15 hours.

(2) The mixture is heated for one hour at 140° C., and moved to an aluminum pot with the stones removed. Then, the mixture is heated to 1200° C. at the rate of 400° C./h, and maintained at 1200° C. level for 1~10 hours before cooled down to a room temperature.

(3) The mixture taken from the pot is churned with water and stones for two hours. The mixtute is applied to the front end surface 23 of the tip 2 as a low resistor layer, and baked at 1000° C. for fifteen minutes so as to fixedly adhered it together to the front end surface 23.

Experiment is carried out to check a relationship between times of sparks and voltage applied across the electrodes 4, 13. Ten igniter plugs manufactured according to the invention are tested with a capacitor discharge (1 μF.) as a high tension source. It is found that all of the ten igniter plug shows that relationship as seen at curve 50 in FIG. 3 which indicates that no substantive fluctuation of discharge voltage appears even during time period when each of the igniter plugs is initially operated.

In the similar manner mentioned above, three igniter plugs are tested which no low resistor layer is provided.

Figure 3:
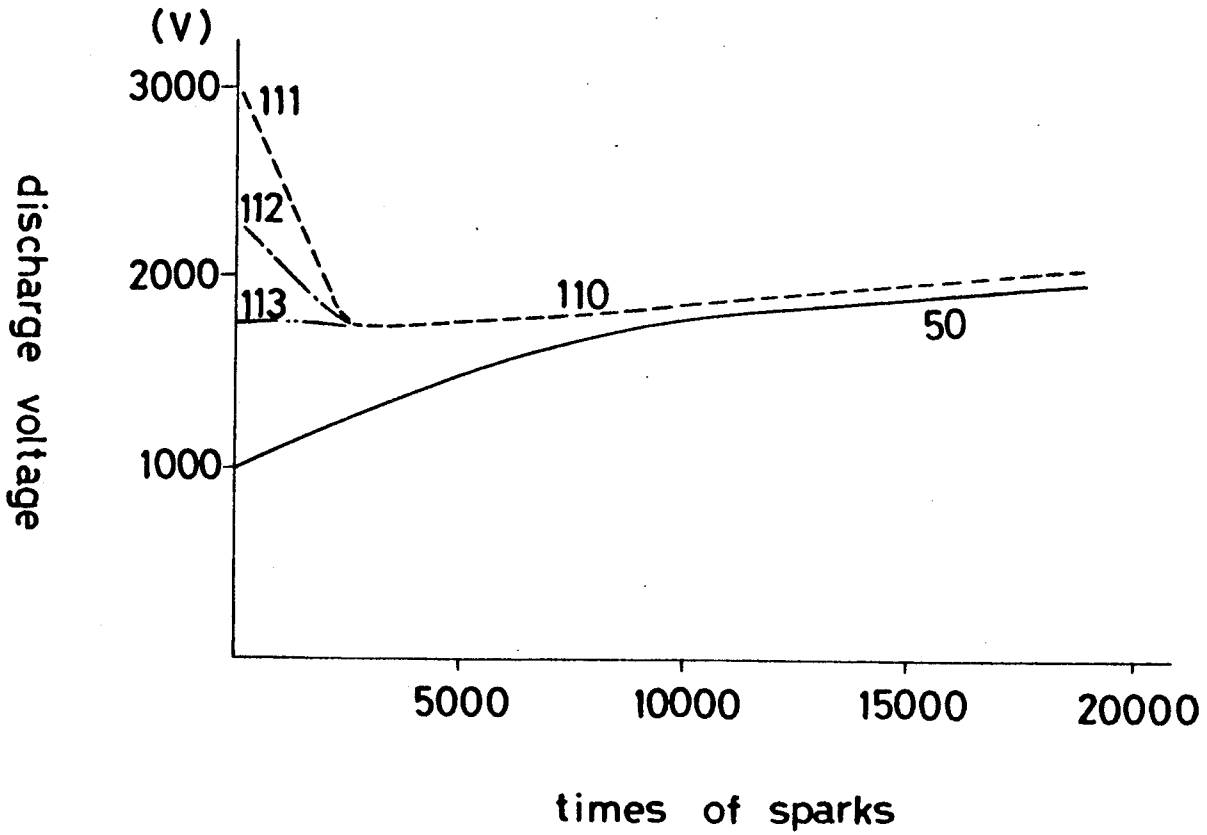
FIG. 3 is a graph showing a relationship between times of sparks and voltage applied across a center electrode and a ground electrode.

In this instance, before 2500 times of sparks has elapsed after each of the igniter plugs is initially operated, it is found that more than 1800 V is required to discharge between two electrodes, and fluctuation of discharge voltage appears as shown at curves 111, 112 and 113 in FIG. 3, although it is found that the curves 111, 112 and 113 respectively converge into a curve 110 with the elapse of 2500 times of sparks.

It is noted that silicon nitride, carbide or titan nitride may slightly be added when the semiconductor tip is made.

It is appreciated that the low resistor layer may be put together on the front end surface of the semiconductor tip by means of evaporation or sputtering instead of baking.

Various other modifications and changes may be also made without departing from the spirit and the scope of the following claims.

What is claimed is:

1. An igniter plug comprising:

a cylindrical metallic shell, a front end of which has a tubular ground electrode;

a hollow semiconductor tip which is in the form of inversed frusto-cone shape, and concentrically placed within the tubular ground electrode;

a tubular insulator placed within the metallic shell to be in alignment with the semiconductor tip;

a center electrode concentrically placed within the insulator, a front end of the center electrode passing through the semiconductor tip to extend beyond a front end of the semiconductor tip so as to provide an annular discharge gap between the front end of the center electrode and that of the ground electrode; and a low resistor layer provided on a front end surface of the semiconductor tip, an electrical resistance of the layer being determined to be smaller than that of the semiconductor tip, while a thickness of the layer being such that the layer precedes the semiconductor tip in forming a discharge path between the front end of the center electrode and that of the ground electrode only during a predetermined time period after the igniter plug is initially operated.

2. An igniter plug as recited in claim 1 wherein the thickness of the low resistor layer is determined to be within the range from 5 μm to 200 μm.

3. An igniter plug as recited in claim 1 wherein the low resistor layer is made of oxidized tin with an addition of antimony trioxide.

4. An igniter plug as recited in claim 1 wherein the low resistor layer is put together on the front end surface of the semiconductor by means of baking.

5. An igniter plug as recited in claim 1 wherein the low resistor layer is put together on the front end surface of the semiconductor by means of evaporation.

6. An igniter plug as recited in claim 1 wherein the low resistor layer is put together on the front end surface of the semiconductor by means of sputtering.

7. An igniter plug as recited in claim 1 wherein the semiconductor tip is made of a sintered body with silicon carbide and alumina as main components.

8. An igniter plug as recited in claim 1 wherein the low resistor layer has an electrical resistance in less than 0.5MΩ exclusive.

* * * * *